US005460137A

United States Patent [19]

Zabeck et al.

[11] Patent Number: 5,460,137

[45] Date of Patent: Oct. 24, 1995

[54] APPARATUS FOR THE TEMPORARY STORAGE AND CONTROLLED FEEDING OF VOLATILE FUEL COMPONENTS TO AN INTERNAL COMBUSTION ENGINE

[75] Inventors: Sebastian Zabeck, Viernheim; Andreas Sausner, Neu Isenberg, both of Germany

[73] Assignee: Firma Carl Freudenberg, Weinheim, Germany

[21] Appl. No.: 115,375

[22] Filed: Sep. 1, 1993

[51] Int. Cl.[6] ..... F02M 33/02

[52] U.S. Cl. ..... 123/520; 123/516

[58] Field of Search ..... 123/520, 516, 123/518, 519, 521, 198 D

[56] References Cited

U.S. PATENT DOCUMENTS

| | | | |
|---|---|---|---|
| 4,026,258 | 5/1977 | Ino | 123/520 |
| 4,237,924 | 12/1980 | Benjamin | 123/510 |
| 4,714,193 | 12/1987 | Yogo | 123/516 |
| 4,901,702 | 2/1990 | Beicht et al. | 123/520 |
| 4,953,514 | 9/1990 | Beicht et al. | 123/520 |
| 5,143,120 | 9/1992 | Tinz et al. | 137/601 |
| 5,172,657 | 12/1992 | Sausner et al. | 123/41.21 |
| 5,184,591 | 2/1993 | Sausner et al. | 123/520 |
| 5,188,141 | 2/1993 | Cook | 123/520 |
| 5,213,066 | 5/1993 | Sausner et al. | 123/41.2 |
| 5,213,087 | 5/1993 | Sausner et al. | 123/568 |
| 5,220,897 | 6/1993 | Buchalla et al. | 123/520 |
| 5,226,397 | 7/1993 | Zabeck et al. | 123/516 |
| 5,249,561 | 10/1993 | Thompson | 123/520 |
| 5,259,354 | 11/1993 | Sausner et al. | 123/520 |
| 5,265,578 | 11/1993 | Zabeck et al. | 123/568 |
| 5,269,278 | 12/1993 | Heinemann | 123/520 |
| 5,284,181 | 2/1994 | Abe | 123/520 |

FOREIGN PATENT DOCUMENTS 2058819 7/1992 Canada .

*Primary Examiner*—Carl S. Miller
*Attorney, Agent, or Firm*—Kenyon & Kenyon

[57] ABSTRACT

An apparatus for the temporary storage and controlled feeding of volatile fuel components from the free space of a fuel tank to the intake manifold of an internal combustion engine is set forth. The apparatus includes a venting line which connects the free space of the fuel tank to the atmosphere. Along this line is interposed a storage chamber containing an absorption element having at least one line which connects the storage chamber to the intake manifold and which can be sealed by an electromagnetically actuated valve. Valve includes a valve seat and a nozzle. The nozzle tapers away from the valve seat at one end to a cross section of reduced area, and then conically widens to a maximum value at the opposite end of the nozzle.

21 Claims, 3 Drawing Sheets

APPARATUS FOR THE TEMPORARY STORAGE AND CONTROLLED FEEDING OF VOLATILE FUEL COMPONENTS TO AN INTERNAL COMBUSTION ENGINE

BACKGROUND OF THE INVENTION

The present invention generally relates to apparatus for the temporary storage and measured feeding of the volatile fuel components present in the free space of a fuel tank into the intake manifold of an internal combustion engine. The apparatus includes a vent line which connects the free space of the fuel tank to the atmosphere. Along this vent line there is disposed a storage chamber containing an absorption element, as well as at least one line connecting the storage chamber to the intake manifold. This line can be shut by an electromagnetically actuated valve which has at least one inlet port and at least one outlet port and a valve seat therebetween which can selectively be sealed by a closing element. More particularly, the present invention relates to improvements in these devices.

Apparatus of this type is disclosed in German Patent 38 02 664, which corresponds to U.S. Pat. No. 4,901,702, the contents of which are herein incorporated by reference. In this apparatus, an auxiliary valve that can be closed by a vacuum advance mechanism and which has a control chamber is located between an electromagnetically actuated valve and the intake manifold. At low engine operating speeds or when the carbon activated absorption element of this device is saturated with vapors, an excessively rich fuel-air mixture may be drawn into the engine. In order to prevent this occurrence, the apparatus employs an auxiliary valve that is connected in series directly in front of a non-return valve. The auxiliary valve comprises a vacuum advance mechanism which consists of a rubber-elastic adjustable membrane and a compression spring, the auxiliary valve having a separate closing element which rests at one end with a support collar against the adjustable membrane and at the other end against the compression spring. During low engine operating speeds in the near idling range, the flow rate of volatile fuel components through the apparatus is reduced so as to prevent the excessive enrichment of the mixture fed to the engine; at high engine operating speeds when the differential pressure between the engine and the tank is reduced, the non-return valve employed is wide open.

This apparatus consists of a large number of individual parts which add to the cost of its manufacture. Due to the large number of individual movable parts employed, the probability of a malfunction occurring rises during long periods of use, which can lead to impairment of the operation of the internal combustion engine to which it is connected.

Another device similar to this general type is disclosed in German Patent 41 00 659 (which corresponds to Canadian Patent Application 2,058,819, the contents of which are incorporated herein by reference). This device employs a series of sensors to monitor the operation of the system by transmitting values concerning a number of selected parameters to a diagnostic unit, where the measured values are compared against a series of predetermined target values.

There remains a need for the further development of the apparatus of the above-described type that is of a substantially simpler construction that is more economical to manufacture and which retains excellent and reliable working properties throughout a long period of use.

SUMMARY OF THE INVENTION

The invention meets these needs by providing an apparatus for the temporary storage and controlled feeding of volatile fuel components from the free space of a fuel tank to an engine manifold. The apparatus comprises a venting line which connects the free space to the atmosphere, a storage chamber containing an absorption element, at least one line which connects the storage chamber to an intake manifold, and an electromagnetically actuated valve located along the line connecting the storage chamber with the intake manifold. The valve selectively seals that line and includes at least one inlet port and at least one outlet port.

In order to provide favorable operating characteristics and to simplify construction, the line linking the fuel tank with the manifold is sealed exclusively by the electromagnetically actuated valve. This valve includes a valve seat axially arranged in the form of a tubular nozzle having in the immediate region of the valve seat a first orifice cross section which tapers down, in the flow direction immediately behind the valve seat, to a second orifice cross section of reduced size. At this point, the nozzle commences to conically widen in the direction facing away from the valve seat to a third orifice cross section which is larger than the first orifice cross section. The nozzle, which may have the form of a Laval-nozzle, effectively accommodates an advantageous throughput, and the regeneration of the absorption element at high speeds of engine rotation in both the partial and full load range. The form of the nozzle results in a comparatively high rate of flow so that the throughput encounters only small resistance to flow. This enables a high mass flow rate of volatile fuel components to be fed to the fuel-air mixture of the fuel intake system and mixed therewith for transport to the combustion zones of the internal combustion engine.

Because of the fluidically advantageous shape of the nozzle, the valve seat can have a relatively small orifice cross section, which enables the employment of relatively small actuating forces with respect to the valve. This is advantageous for the regeneration of the absorption element in the near idling range. Due to the comparatively small orifice cross section of the valve seat and the correspondingly small actuating forces required to actuate and control the valve, the valve can be held in the closed position during clocked control for a longer period of time so that the excessive enrichment of the fuel-air mixture can be avoided despite regeneration of the absorption element in the idling range.

Accordingly, the apparatus provides for the precise metering of the volatile fuel components into the intake manifold both in a regime characterized by large differential pressure and low operating speed (e.g., during idling), as well as regimes of high flow rates of volatile fuel components and lower differential pressures that arise in the partial and full load range.

The valve may be electrically linked to a diagnostic unit, in much the same manner shown in German Patent 41 00 659, the contents of which are incorporated herein by reference. The diagnostic unit is used to monitor the system to help assure its proper operation. For example, the diagnostic unit, which may interface with or include a component of a target characteristics memory table for an engine control system, controls the valve and thus the volumetric flow of volatile fuel components into the intake manifold of the internal combustion engine as a function of various input variables and as a function of the load condition at a given time. The electromagnetically actuated valve can, for instance, be controlled by clocked pulses and releases and, depending on the pulse duty factor employed, transfer metered quantities of volatile components through the valve. (The term "pulse duty factor" is understood to refer to the relationship between the period of time in which the valve is in the "open" state to the total period made up of both the "open" and "closed" states.) As noted, to monitor the system, the diagnostic unit can be connected to a control instrument. When a predetermined threshold value defining the difference between the desired value and the actual value relating to the mass flow through the valve is exceeded, visual and/or acoustic signals can alert the operator of the internal combustion engine of the condition, which may signal a malfunction. The input signals of the diagnostic unit can be based on a number of parameters, including the position of the throttle valve, the speed of the internal combustion engine, various temperatures and pressures inside and outside of the internal combustion engine and the exhaust gas composition. Additional input and output variables may also form a useful basis for control.

One factor that is useful in providing excellent control over the transfer of volatile fuel components in the near engine idling range, as well as high throughput when the engine is operating in the partial and full load operation, is nozzle orifice size. In particular, advantageous properties are obtained when the area of the first orifice cross section is 1.01 to 2.5 times greater than the area of the second orifice cross section, and when the area of the third orifice cross section is 1.05 to 4 times greater than the area of the second orifice cross section. Since the second orifice cross section is the narrowest point of the nozzle cross section, this dimension is of primary importance with respect to the other dimensions of the nozzle. The nozzle limiting wall widens beneath the second orifice cross-section in the shape of a cone in the direction of flow, and forms with the axis of symmetry of the nozzle an angle of between 2° to 8°, and preferably an angle of 4°.

This conical form can be contrasted to a form where the first and the second orifice cross-sections of the nozzle are of equal size, in that in the latter case, the working properties of the apparatus are fluid mechanically less favorable.

In order to improve the mass flow of volatile fuel constituents in the partial load and full load range of the internal combustion engine, the first orifice cross section and the inlet port can be arranged in a first plane and/or the third orifice cross section can be arranged in a second plane together with the outlet port. In order to provide for the efficient removal of volatile fuel components from the absorption element, low flow losses are required, particularly during high speeds of engine rotation when the differential pressure is comparatively small due to the almost fully opened throttle valve.

This design criteria is advanced by forming the nozzle so that there are no sudden jumps in cross-section size; i.e., the first orifice cross section, the second orifice cross section and the third orifice cross section are developed so that they pass one into the other without presenting any sudden jumps in the cross section of the nozzle.

The first orifice cross section has preferably a diameter which is 2–8 times and preferably 4 times larger than the stroke of the closing element. The efficient passage of the volatile fuel components through the valve concomitant with the smallest possible regulating path is obtained so that the electromagnetically adjusted valve has a particularly wide dynamic range.

BRIEF DESCRIPTION OF THE DRAWINGS

One embodiment of the invention will be explained in greater detail below with reference to the accompanying drawings, in which.

DETAILED DESCRIPTION OF THE DRAWINGS

Figure 1:
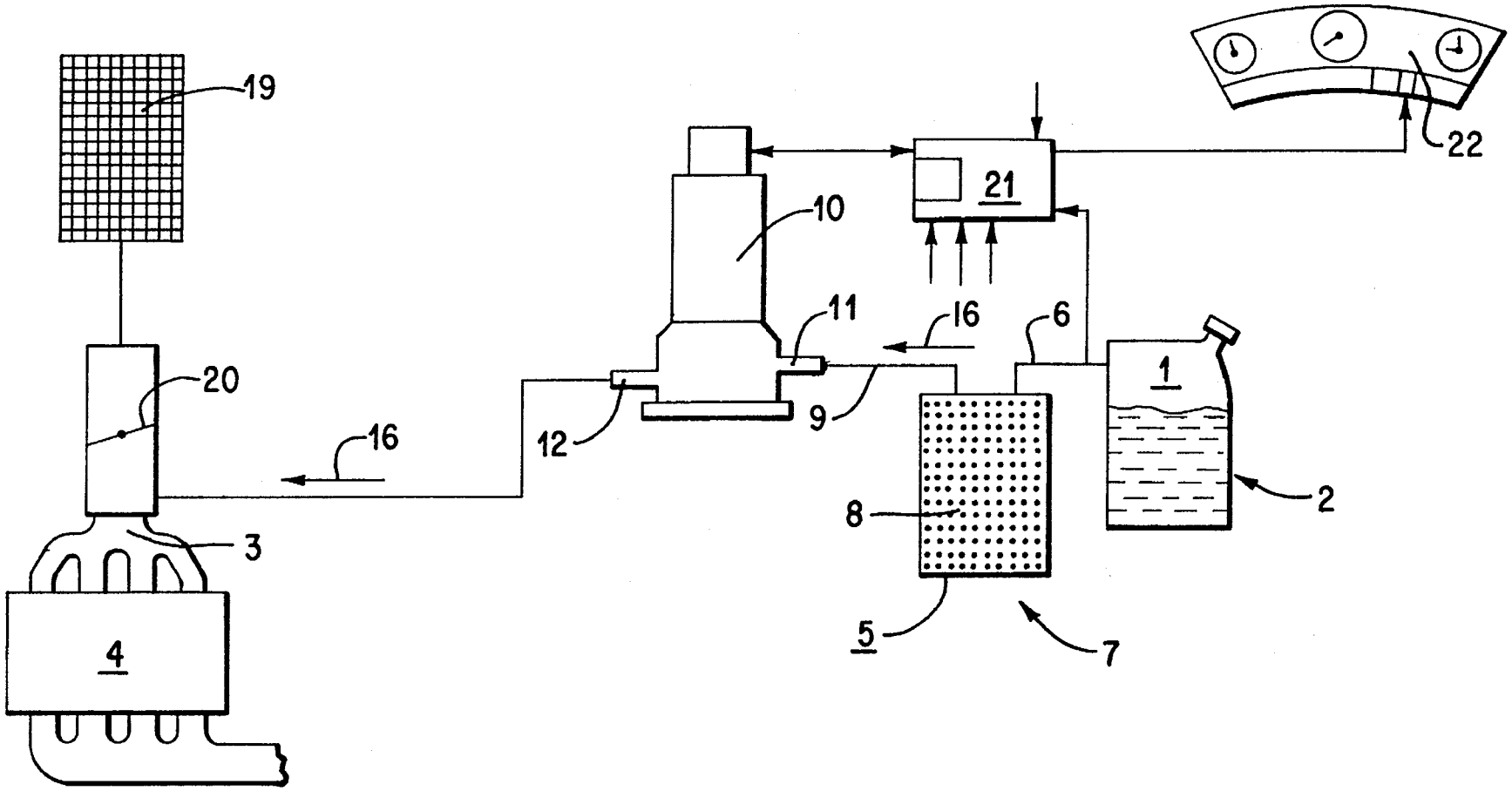
FIG. 1 is an overall view in which the individual parts used are shown schematically.

The device shown in FIG. 1 comprises an internal combustion engine 4 having an intake manifold 3, an air filter 19 and a throttle valve 20 (shown on a larger scale) that is located inside the intake manifold 3. (In order to simplify the illustration, the fuel injection unit, which may be a carburetor or another injection unit which can be controlled via the diagnostic unit 21 as part of an engine control system has not been shown.) FIG. 1 schematically illustrates the electromagnetically actuated valve 10. It has an outlet port 12 and an inlet port 11 which are connected via a line 9 to an absorption element 8 located within a storage chamber 7. The absorption element 8 may be an activated carbon filter. Volatile fuel components from the free space 1 of the tank system 2 pass via a venting line 6 into the storage chamber 7 and are taken up by the absorption element 8.

The line is sealed exclusively by the electromagnetically actuated valve 10, which simplifies the construction of the system. During the operation of the internal combustion engine 4, the volatile fuel components flow through the valve 10, which is controlled (i.e., opened and closed) via various clock pulses as a function of the load condition of the internal combustion engine at a given time. The fuel components are drawn in by the vacuum in the intake manifold 3 of the internal combustion engine 4. The volatile fuel components are fed to the manifold in the flow direction 16 towards the throttle valve 20. The diagnostic unit 21 and the indicating instruments 22 serve to monitor and control the valve. The passage of volatile fuel components into the internal combustion engine 4 is regulated as a function of input variables such as the position of the throttle valve 20, the speed of rotation of the internal combustion engine 4, and/or the composition of the exhaust gas. A sensor can be provided for the determination of the volatile fuel components that have passed through the valve into the intake manifold. This sensor can be arranged within the manifold just behind the throttle valve 20.

Figure 2:
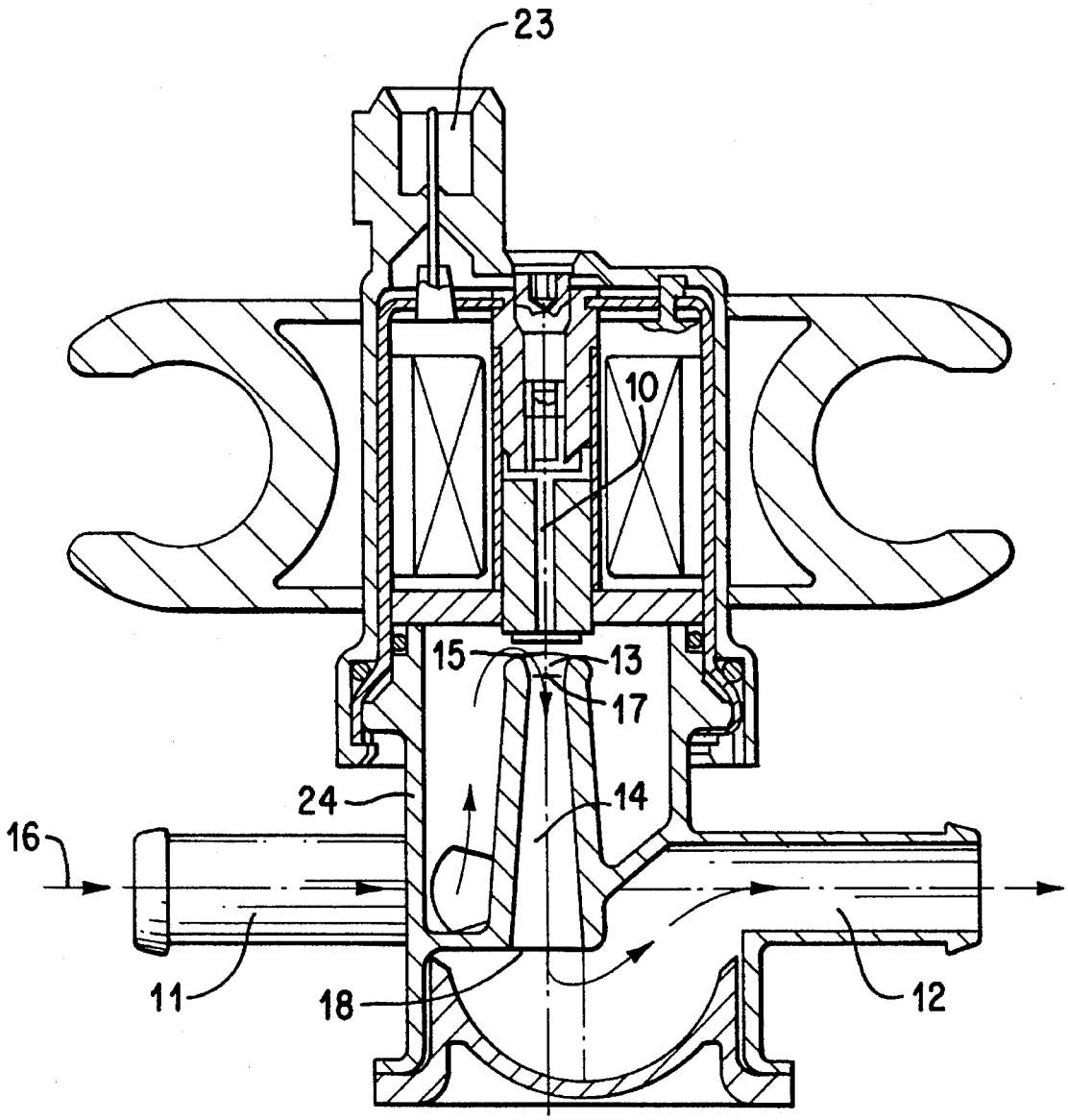
FIG. 2 is a cross-sectional view of the electro-magnetically actuated valve shown as part of FIG. 1.

FIG. 2 illustrates in cross-sectional detail an embodiment of the valve 10 of the device according to FIG. 1. The valve 10 has an electric drive 23 which is connected with the diagnostic unit 21 (FIG. 1) in a manner to permit the passage of signals therebetween. The valve actuator 23 controls the flow as a function of the values of the aforementioned parameters as governed by commands from the diagnostic unit 21. The line connecting the storage chamber 7 with the manifold can be sealed off exclusively by the valve 10. Within the housing 24 of the valve 10 is a tapered nozzle 14. Within the nozzle, the valve seat 13 has a first orifice cross-section 15 whose area tapers down to a minimum at the second orifice cross-section 17 located immediately behind the valve seat, at which point it begins to conically widen in the direction of fluid flow toward a third orifice cross section 18. The angle of the cone which is formed by the limiting wall of the nozzle 14 and the axis of the nozzle 10 is 4° in this embodiment. In accordance with the preferred embodiment, the second orifice cross section 17 is axially displaced from the valve seat 13 a distance that is preferably less than or equal to one third of the overall axial extent of the nozzle.

Figure 3:
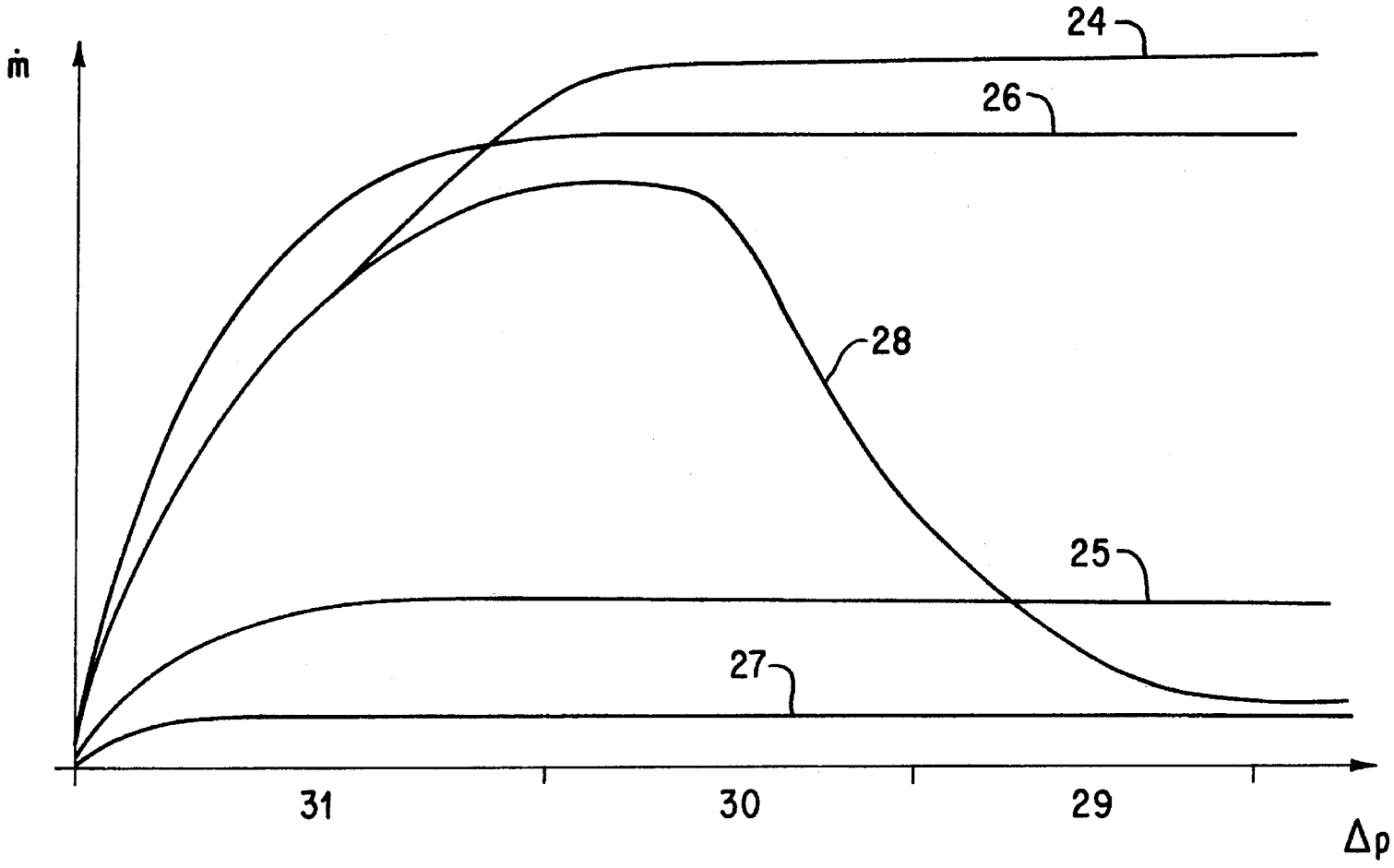
FIG. 3 is a graph of the flow rate of the volatile fuel constituents through the nozzle as a function of the differential pressure corresponding to a number of load regimes for both the instant invention and a prior art device.

FIG. 3 shows a number of graphs which the mass flow rate dm/dt of the volatile components is plotted on the ordinate and the pressure differential Δp is plotted on the abscissa. At the origin, both the flow rate dm/dt and the pressure differential Δp are zero. This graph diagrammatically illustrates the relationships between the various developments of the valves (i.e., it does not plot particular numerical values). The abscissa to the right of the origin is divided into three segments 29, 30, and 31, which corresponds to the operating conditions of the internal combustion engine 4. Segment 29 represents the idle range, segment 30 the partial load range, and segment 31 the full load range.

The curves characteristic of a valve which is developed similar to the valve of FIG. 2, but which has a nozzle of cylindrical cross section, are shown at curves 24 and 25. Graphs characteristic of the valve 10 of the invention shown in FIG. 2 having a conical nozzle are shown at curves 26 and 27. Curves 24 and 26 correspond to the case of the valve being wide open, and curves 25 and 27 correspond to the minimal level of throughput under clocked control. The operating behavior of the valve disclosed in German Patent 32 02 664 and German Patent 41 00 659 (which employs an auxiliary valve seat in addition to a main valve seat) is described by graph 28.

A valve having a cylindrical nozzle has a number of disadvantages. It can be operated so as to maximize the removal of fuel components from the absorption element in full load regime without idling regeneration, but the with large orifice cross sections and fully opened valve, as shown by curve 24, results in the excessive enrichment of the fuel-air mixture during idling. Curve 25 shows the smallest possible dosed quantity with clocked control for that valve. By comparing curve 25 with curves 27 and 28, it is seen that the mass flow rate dm/dt in the idling range 29 is considerably larger for the cylindrical nozzle, which leads to an undesirable level of air-fuel enrichment during idling.

One may design the orifice cross sections of the valve seat in a cylindrical nozzle correspondingly smaller so that idling regeneration can take place and the mass flow rate would then extend over the pressure difference approximately corresponding to graph 27. However, this has the disadvantage that in the partial load and full load range there would take place a mass throughput through the device which is much too small and so that during partial a full load the absorption element would not be optimally regenerated. Both developments of the valve are quite unsatisfactory with regard to their properties in use.

Graph 28 illustrates the properties of the valve which is known from the prior art and which consists of an auxiliary valve seat and a main valve seat. By means of the vacuum advance mechanism, the valve can almost be sealed in order to limit the mass flow rate dm/dt of volatile fuel components in the region between throttle valve 20 and internal combustion engine 4. While this design better provides for the appropriate measured feeding of lesser levels of the volatile fuel components into the internal combustion engine in the near idling range 29 as well as hand a comparatively high mass flow rate dm/dt at partial load regime 30 and full load regime 31, it is complex in its design.

Due to the advantageously developed nozzle, the valve 10 of the invention has in its fully opened condition (curve 26) a mass throughput which is only slightly below the mass throughput of a cylindrical nozzle of large orifice cross section. Due to the reduced flow losses, the high mass throughput is retained far into the range of the full load operation. By using clocked control of the valve for finer levels of feeding of the volatile fuel components in the near idling operation 29, one obtains the curve 27.

It is noted that the valve shown in FIG. 2 is of very simple design and can be manufactured in cost-favorable and economical. It also provides excellent properties in use both with respect to the maximum throughput with the valve fully opened and also for more measured, lesser flow levels in the near idling range 29.

What is claimed is:

1. An apparatus for the temporary storage and controlled feeding of volatile fuel components from the free space of a fuel tank to an engine manifold, comprising:

a venting line which connects the free space to the atmosphere;

a storage chamber containing an absorption element;

at least one line which connects the storage chamber to an intake manifold; and an electromagnetically actuated valve located along the line connecting the storage chamber with the intake manifold, said valve selectively sealing that line and including at least one inlet port and at least one outlet port;

a sealing member and a nozzle having a corresponding valve seat having a first cross section located between the inlet port and the outlet port, which valve seat can be sealed as required by the sealing member, said nozzle tapering in the direction facing away from the valve seat to a second orifice cross section and then widening to a third orifice cross section that is wider than the first orifice cross section; and electromagnetic means for effecting the sealing and unsealing of the valve.

2. A device according to claim 1, wherein the nozzle has a substantially circular orifice cross section.

3. A device according to claim 1, wherein the area of the first orifice cross section is 1.01 to 2.5 times greater than the area of the second orifice cross section.

4. A device according to claim 1, wherein the area of the third orifice cross section is 1.05 to 4 times larger than the area of the second orifice cross section.

5. A device according to claim 1, wherein the length of the nozzle is 4 to 12 times larger than the diameter of the second orifice cross section.

6. A device according to claim 1, wherein the first orifice cross section and the inlet port are arranged in a first plane.

7. A device according to claim 1, wherein the third orifice cross section and the outlet port are arranged in a second plane.

8. A device according to claim 1, wherein the first orifice cross section, the second orifice cross section and the third orifice cross section are developed continuously passing into each other without sudden changes in cross section of the nozzle.

9. A device according to claim 1, wherein the first orifice cross section has a diameter which is 2 to 8 times larger than the stroke of the valve.

10. A device according to claim 4, wherein the length of the nozzle is 4 to 12 times larger than the diameter of the second orifice cross section.

11. A device according to claim 10, wherein the first orifice cross section and the inlet port are arranged in a first plane.

12. A device according to claim 2, wherein the first orifice cross section, the second orifice cross section and the third orifice cross section are developed continuously passing into each other without sudden changes in cross section of the nozzle.

13. A device according to claim 12, wherein the first orifice cross section has a diameter which is 2 to 8 times larger than the stroke of the valve.

14. An apparatus for reducing the evaporative loss of fuel in an fuel tank, comprising:

a fuel tank;

a storage chamber containing a fuel absorptive element and a line linking the storage chamber to the fuel tank; and a line connecting the storage chamber to the intake manifold of an internal combustion engine, said line being sealable by a valve, said valve including a nozzle that has a valve seat and a direction of fluid flow, wherein said nozzle first tapers in the direction of fluid flow and then conically widens in the direction of fluid flow to a cross sectional area that is greater than the cross sectional area of the valve seat of the nozzle.

15. A method for reducing the evaporative loss of fuel from a fuel tank, comprising:

sealing the fuel tank so that fuel vapors cannot directly flow from the fuel tank to the atmosphere;

fluidically connecting a storage chamber containing an absorptive element to the fuel tank;

fluidically connecting the storage chamber to a selectively actuable valve of the type defining a selectively sealable fluid pathway for the vapors to follow, said fluid pathway including a nozzle of smoothly varying cross sectional area that tapers from a first cross sectional area to a smaller second cross sectional area before widening to a third cross sectional area that is wider than the first cross sectional area; and fluidically connecting the selectively actuable valve to an engine.

16. The method of claim 15, further including the steps of determining the engine condition, determining the vapor flow rate appropriate to the engine condition, and then actuating the valve so that it permits the passage of a corresponding flow rate of vapor for a given interval of time.

17. The method of claim 16, wherein the valve is responsive to the control of a clocked series of electrical impulses in response to which the valve opens and closes.

18. The method of claim 17, wherein the clocked series of electrical impulses is generated by a computer in dependance upon the engine condition.

19. The method of claim 18, wherein the individual electrical impulses are collectively provided in a first time interval having a length T1, during which time T1 the valve is in a closed state an aggregate length of time that is less than the time the valve is in the open state.

20. The method of claim 19, wherein the length of time that the valve is in an open state is sufficient with respect to the length of time that the valve is kept in a closed state to permit the delivery of an appropriate quantity of fuel vapor from the storage chamber to the engine.

21. The method of claim 20, wherein the length of time that the valve is held in an open state is sufficient with respect to the length of time that the valve is kept in a closed state to permit the storage chamber to be recharged with fuel vapors.

* * * * *